US007996992B2

(12) United States Patent
Björni

(10) Patent No.: US 7,996,992 B2
(45) Date of Patent: Aug. 16, 2011

(54) METHODS FOR MOUNTING ONE OR MORE ROPES ON A ROPE PULLEY

(75) Inventor: Osmo Björni, Hyvinkää (FI)

(73) Assignee: Kone Corporation, Helsinki (FI)

( * ) Notice: Subject to any disclaimer, the term of this patent is extended or adjusted under 35 U.S.C. 154(b) by 625 days.

(21) Appl. No.: 11/826,735

(22) Filed: Jul. 18, 2007

(65) Prior Publication Data

US 2008/0029347 A1 Feb. 7, 2008

Related U.S. Application Data

(63) Continuation of application No. PCT/FI2006/000021, filed on Jan. 27, 2006.

(30) Foreign Application Priority Data

Jan. 28, 2005 (FI) ..... 20050096

(51) Int. Cl.
*B21K 1/42* (2006.01)

(52) U.S. Cl. ..... 29/892.1; 29/892; 187/243

(58) Field of Classification Search ..... 29/892, 29/892.1; 187/243; 474/130
See application file for complete search history.

(56) References Cited

U.S. PATENT DOCUMENTS 173,871 A * 2/1876 Thomas ..... 474/130
685,926 A * 11/1901 Mundlos ..... 474/130

FOREIGN PATENT DOCUMENTS

JP 2002-362851 A 12/2002
JP 2005-67820 A 3/2005

* cited by examiner

*Primary Examiner* — Rick K Chang
(74) *Attorney, Agent, or Firm* — Harness, Dickey & Pierce, P.L.C.

(57) ABSTRACT

A method for mounting one or more ropes on a rope pulley includes fitting a first end of the one or more ropes into one or more corresponding rope grooves of the rope pulley, attaching a rope holder to the rope pulley to press the first end of the one or more ropes into the one or more corresponding rope grooves of the rope pulley, and winding the one or more ropes at least partially around the rope pulley by rotating the rope pulley.

19 Claims, 4 Drawing Sheets

METHODS FOR MOUNTING ONE OR MORE ROPES ON A ROPE PULLEY

PRIORITY STATEMENT

This application is a continuation of PCT/FI2006/000021, filed on Jan. 27, 2006, which is an international application claiming priority from FI 20050096, filed Jan. 28, 2005, the entire contents of which are hereby incorporated by reference.

BACKGROUND

1. Field

The present invention relates to methods for mounting one or more ropes on a rope pulley and to devices for mounting one or more ropes on a rope pulley.

2. Description of Related Art

New elevator solutions are increasingly frequently implemented using large suspension ratios, necessitating the use of a plurality of rope pulleys in the rigging. The rope suspension of a modern elevator may comprise as many as over 20 diverting pulleys. In addition, modern elevators often use thin high-strength ropes, a plurality of which may be placed side by side.

According to prior art, elevator hoisting ropes are mounted manually in the rope grooves of a diverting pulley by feeding ropes onto the diverting pulley and rotating the diverting pulley in the direction of rope feed. Jump guards or similar devices keep the ropes in the rope grooves. However, diverting pulleys are often placed in a casing, and consequently feeding the ropes onto the diverting pulley inside the casing is a difficult and time-consuming task. It is particularly difficult to mount the ropes on an encased diverting pulley when the ropes are passed around the encased diverting pulley in a structure where the grooves of the diverting pulley are at least partially hidden inside the casing. In such cases, the casing often has to be disassembled to allow the ropes to be mounted. This problem has a pronounced significance in new elevator solutions which, due to the rope suspension, comprise a plurality of diverting pulleys, with the result that the task of mounting the ropes in connection with first installation or rope change requires a very great deal of time.

Specification JP 2002-362851 discloses a solution in which the elevator hoisting ropes are pulled around the traction sheave by means of a pulling line, and this specification also describes attachment of the pulling line to the traction sheave, but it contains no description of clamping the ropes or their ends against a rope pulley by means of a rope holder.

The object of the present invention is to overcome the above-mentioned drawbacks and create a method enabling fast and reliable mounting of a rope and an easy-to-manufacture device economical in cost and enabling fast and reliable mounting of a rope for pulling ropes onto a rope pulley. The methods for mounting one or more ropes on a rope pulley are discussed below. Correspondingly, the devices for mounting one or more ropes on a rope pulley also are discussed below. Some embodiments of the invention are characterized by what is disclosed in the claims.

Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Similarly, details presented in connection with each embodiment example of the invention can be applied in other embodiment examples as well.

Hereinafter, the method and device of the invention are referred to by the common designation 'solution of the invention'. Moreover, the device alone is referred to hereinafter by the term 'rope holder', describing the manner of application of the device. The advantages of the solution of the invention include a simple, functional and maintenance-free rope holder structure and the fact that it allows the elevator ropes to be mounted quickly and reliably even in the case of a roping that comprises a plurality of diverting pulleys. In addition, the invention makes it possible to mount the ropes onto an encased rope pulley quickly and easily. A further advantage is that the rope holder makes it possible to mount the ropes onto the diverting pulley without opening the casing even when the ropes are passed around an encased diverting pulley in a structure where the grooves of the diverting pulley are at least partially hidden inside the casing. An additional advantage is that mutually adjacent ropes can easily be kept in good order during the mounting operation, so the ropes will not be tangled with each other.

BRIEF DESCRIPTION OF THE DRAWINGS

In the following, the invention will be described in detail with reference to an embodiment example and the attached drawings, wherein.

DETAILED DESCRIPTION OF EXAMPLE EMBODIMENTS

Figure 1:
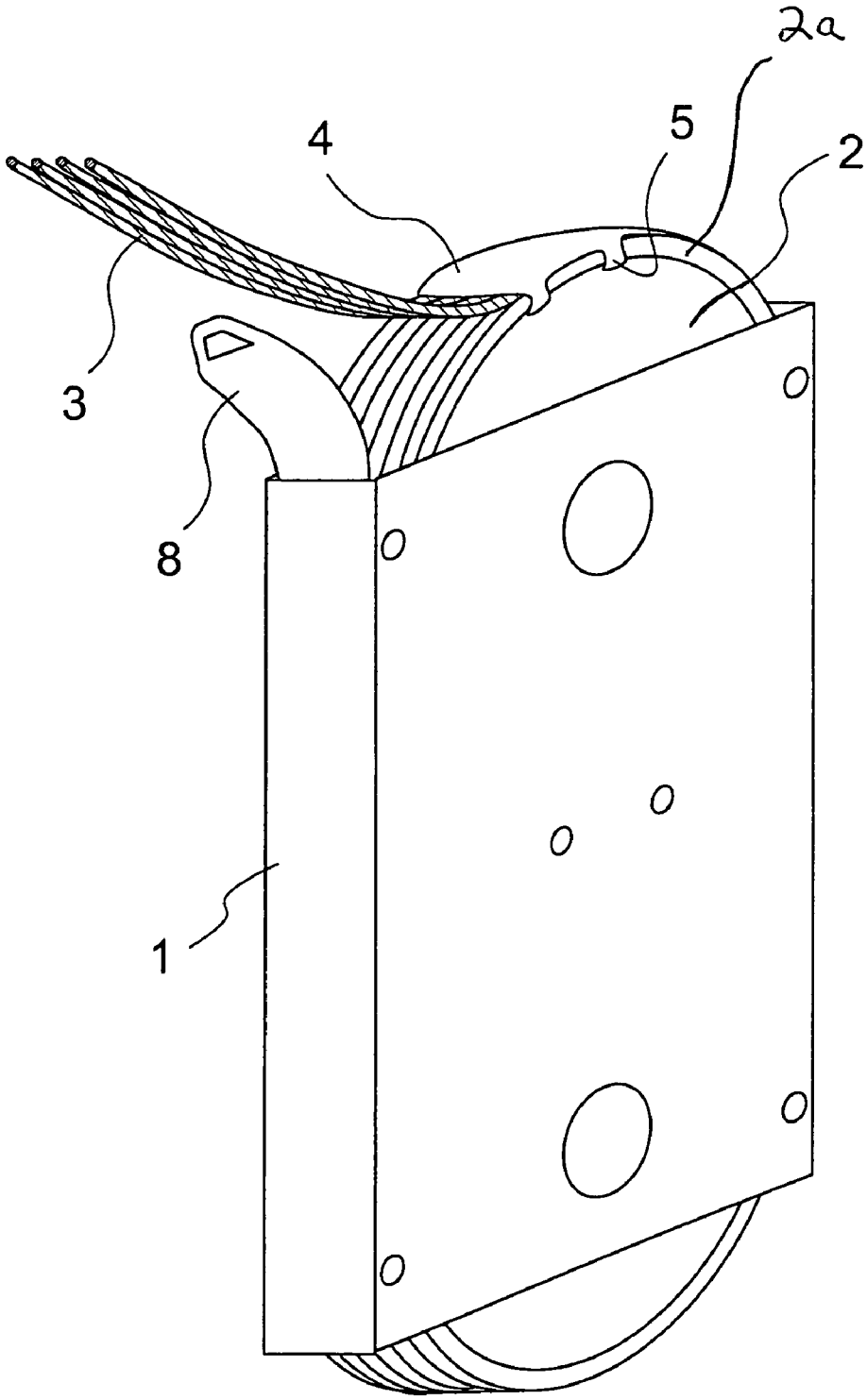
FIG. 1 presents an oblique top view of a rope holder according to the invention, attached to an encased diverting pulley.

FIG. 1 presents a diverting pulley casing 1 provided with two rope pulleys 2 functioning as diverting pulleys, placed one above the other. This type of casing structures are often used e.g. in elevators having a large suspension ratio, requiring many diverting pulleys. The rope holder of the invention can also be readily used in other casing solutions comprising only one or more diverting pulleys. The elevator hoisting ropes 3 running side by side are placed in the rope grooves on the upper rope pulley 2 so that the rope ends are clamped between the rope grooves and a flexible rope holder 4 fastened to the flange 2*a* at the periphery of the rope pulley 2. The rope holder 4 is tightened against the inner surface of the flange 2*a* of the rope pulley 2 by spring-like inwards-bent claws 5. Correspondingly, the stem part 8 of the rope holder 4 is bent over the rope pulley 2 along the outer surface of the rope pulley around the rope pulley 2 in such manner that, in FIG. 1, the leading end of the stem part 8 of the rope holder 4 projects suitably out over the forward upper edge of the casing 1. The bending of the rope holder 4 around the rope pulley 2 will be described in greater detail below in connection with the description of the method.

Figure 2:
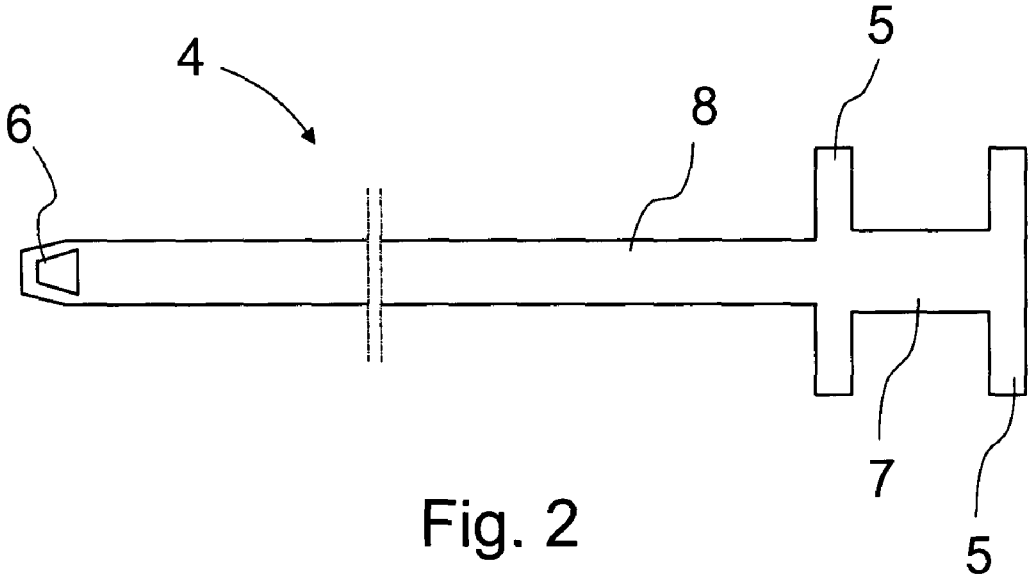
FIG. 2 presents a top view of the rope holder of the invention at the manufacturing stage in a shortened form.

FIG. 2 presents the rope holder 4 of the invention at the manufacturing stage as a separate piece and shortened in its lengthwise direction and before the claws 5 are bent into their final shape. The strip-like rope holder 4 consists of a band-like and flexible material made of metal, e.g. steel, which has been so processed that the rope holder has a spring-like structure. At the trailing end of the rope holder 4 is a clamping part 7, which is a thin, substantially planar structure of rectangular form in the longitudinal direction of the rope holder. At the trailing end of the rope holder are two claws 5 projecting perpendicularly sideways from the clamping part 7, one claw on either side. Placed at a distance towards the leading end from the claws 5 at the trailing end are another two claws 5 corresponding to the aforesaid claws. Thus, there are a total of two substantially identical claws 5 on either side of the rope holder at the leading and trailing ends of the clamping part 7.

From the claws 5 towards the leading end, the rope holder has a strip-like, elongated, flexible stem part 8 extending as an even band-like structure towards the leading end of the rope holder, which leading end tapers forward in a wedge-like manner. The length of the stem part 8 is appropriately selected so that the total length of the stem part 8 and the clamping part 7 is substantially equal to or suitably greater than the length of the corresponding circumference of the rope pulley 2. The elongated stem part 8 makes it possible to thread the ropes around an encased rope pulley even when part of the rope pulley is hidden inside the casing. The hoisting ropes can therefore be easily and quickly mounted even on encased diverting pulleys to which the ropes come from above and, having passed around the diverting pulley, return upwards again, or similarly when the ropes come from below and, having passed around the diverting pulley, run downwards again. The leading end of the stem 8 of the rope holder 4 is additionally provided with an aperture 6 to allow the rope holder to be fastened to a pulling line, pulling tool or equivalent, by means of which the rope holder 4 is pulled around the rope pulley 2, simultaneously guiding the ropes 3 onto the rope pulley.

Figure 3:
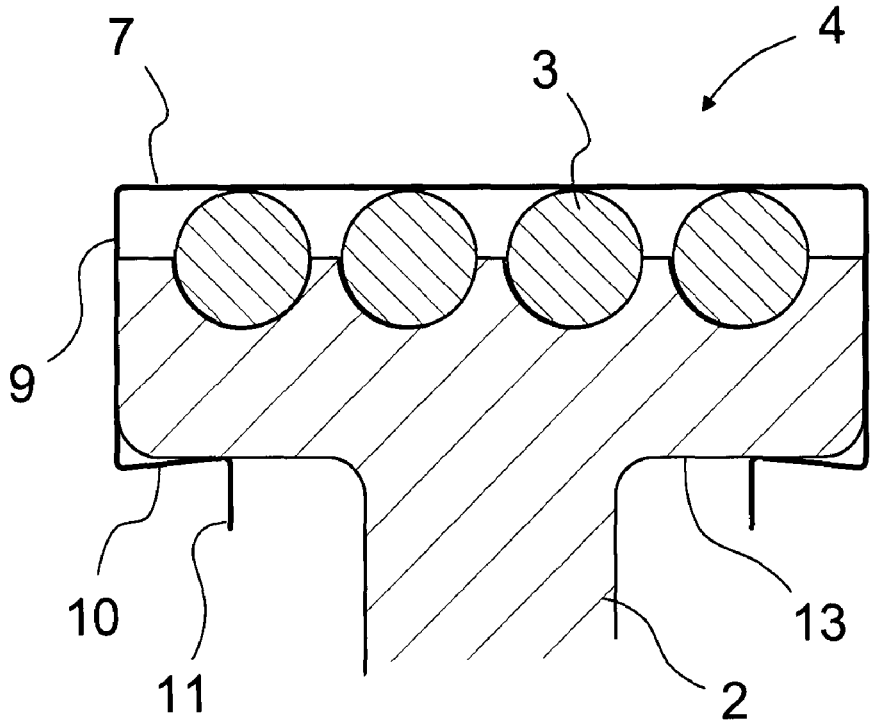
FIG. 3 presents the rope holder of the invention attached onto a rope pulley in a sectional view from behind.

FIG. 3 presents the rope holder 4 of the invention, mounted on a rope pulley 2 and seen from the direction of the trailing end. To render the figure more illustrative, both the rope pulley 2 and the hoisting ropes 3 are shown in cross-section. At the manufacturing stage, the claws of the rope holder 4 are bent such that each claw 5 has a first deflection 9, which is bent substantially perpendicularly downwards from the side edge of the clamping part 7. Thus, both the width of the clamping part 7 and the distance between the opposite claws 5 substantially correspond to the width of the flange forming the outer rim of the rope pulley 2 for which the rope holder 4 is intended. On rope pulleys of different widths, it is preferable to use a rope holder designed for the rope pulley in question.

As an extension of deflection 9, the rope holder has a second deflection 10 bent inwards, i.e. towards the longitudinal center axis of the rope holder 4. The second deflection 10 has been bent suitably to an angle somewhat over 90° relative to the first deflection 9. Thus, the second deflection 10 is in a somewhat inclined position such that the tail of the second deflection 10 rises towards the clamping part 7. Similarly, the rope holder has a third deflection 11 forming an extension of the end portion of the second deflection 10 and bent suitably to an angle somewhat below 90° relative to the second deflection 10 so that the third deflection 11 and the first deflection 9 extend in substantially parallel directions, although this is not necessary.

The dimensions and positions of the deflections 9-11 of the rope holder intended for each rope pulley size have been adapted with respect to the dimensions of the rope pulley and the hoisting ropes 3 used, so that, when mounted on a rope pulley 2, the spring-like claws 5 with their deflections 9-11 produce a force pressing the hoisting ropes 3 into the rope grooves of the rope pulley 2. In this situation, the angle between the second deflection 10 and the third deflection 11 is touching the inner surface 13 of the flange forming the outer rim of the rope pulley 2 and pulls the clamping part 7 of the rope holder 4 towards the outer surface of the outer rim of the rope pulley. The clamping force is so selected that it is sufficient to keep the hoisting ropes 3 in the rope grooves by friction during the entire pulling movement, by which pulling movement the hoisting ropes 3 are guided over the rope pulley 2, simultaneously rotating the rope pulley. Thus, the bent claws 5 function as clamping and locking elements of the rope holder 4 and the ends of the ropes 3.

Figure 4:
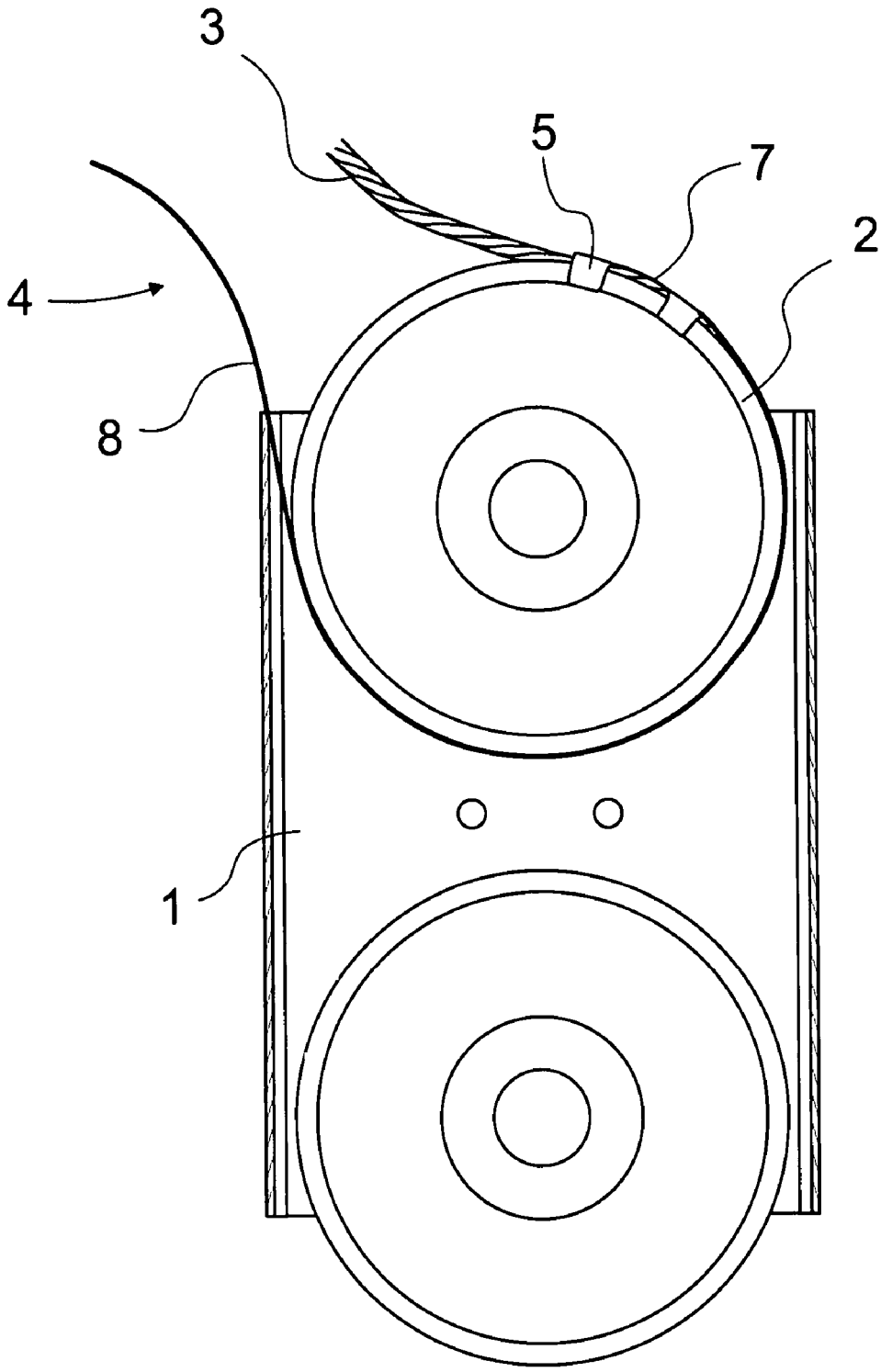
FIG. 4 presents a side view of the rope holder of the invention attached to an encased diverting pulley with the casing opened.

By the method of the invention, the ropes are mounted on a rope pulley by using a strip-like rope holder 4 as described above, e.g. as follows. First, the rope holder 4 is fastened without the ropes by its clamping part 7 to the flange of the rope pulley 2 by means of the claws 5. After this, the rope pulley 2 is rotated so that the rope holder 4 advances with the clamping part 7 first into the casing 1 and passes with the clamping part 7 first substantially around the rope pulley 2. In a case as illustrated in FIGS. 1 and 4, the rope pulley 2 is rotated anti-clockwise at this stage. The rope pulley 2 is rotated until the clamping part 7 of the rope holder 4, having passed around with the rope pulley, comes out of the casing 1 approximately to its starting point again. The length of the stem part 8 of the rope holder 4 is suitably dimensioned so that, when the clamping part 7 is again at about its starting point, the stem part 8 has not been drawn entirely into the casing 1, but the leading end of the stem part 8 remains visible outside the casing 1.

Next, the clamping part 7 is detached from the rope pulley either completely or only at its trailing end, and the ends of the ropes 3 are fitted into the grooves of the rope pulley 2 and pressed into position in the grooves by locking the clamping part 7 again by means of the claws 5 to the flange of the rope pulley 2 so that the ends of the ropes 3 remain at least under the clamping part 7. After the ends of the ropes 3 have thus been locked to the rope grooves of the rope pulley 2 by clamping, the ropes 3 are mounted on the rope pulley 2 by pulling the rope holder 4 by the leading end of the stem part 8 of the rope holder and guiding the ropes 3 to pass over the rope pulley. If the rope pulley 2 does not readily rotate by itself during the pulling, the movement of the ropes 3 into position is additionally assisted if necessary by rotating the rope pulley 2 and simultaneously feeding the ropes 3 onto the rope pulley 2 as loosely as possible. The rope holder 4 protects the rope ends and guides the ropes along the grooves of the rope pulley around the rope pulley 2, and thus the jump guards placed in the casing near the outer rim of the rope pulley 2 are not an obstacle to the installation of the ropes. The jump guards are omitted from the drawings for the sake of clarity.

Figure 5:
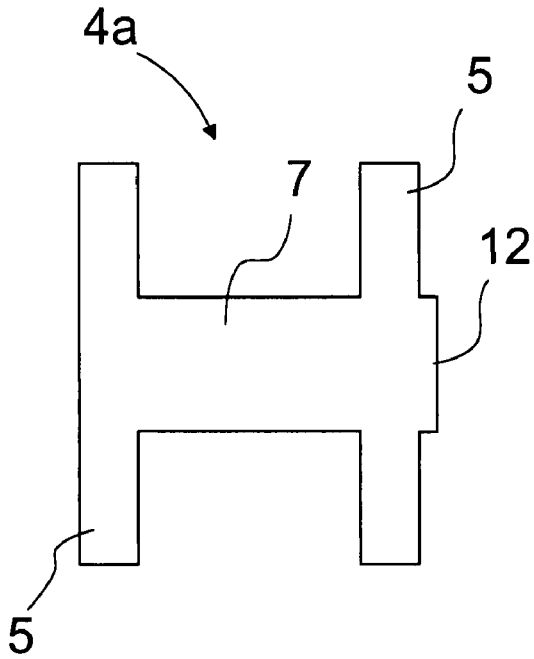
FIG. 5 presents a top view of a rope holder according to a preferred embodiment of the invention at the manufacturing stage.
Figure 6:
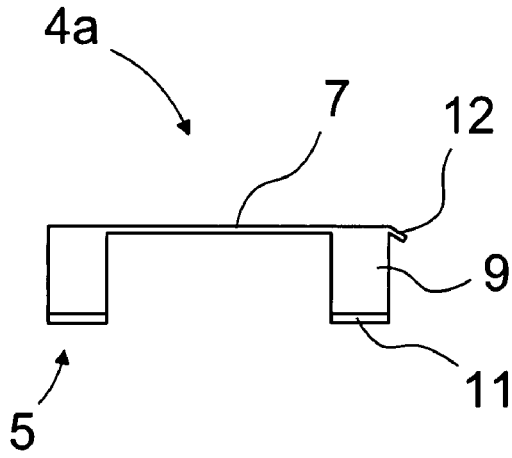
FIG. 6 presents a side view of the rope holder of FIG. 5 in the finished form.
Figure 7:
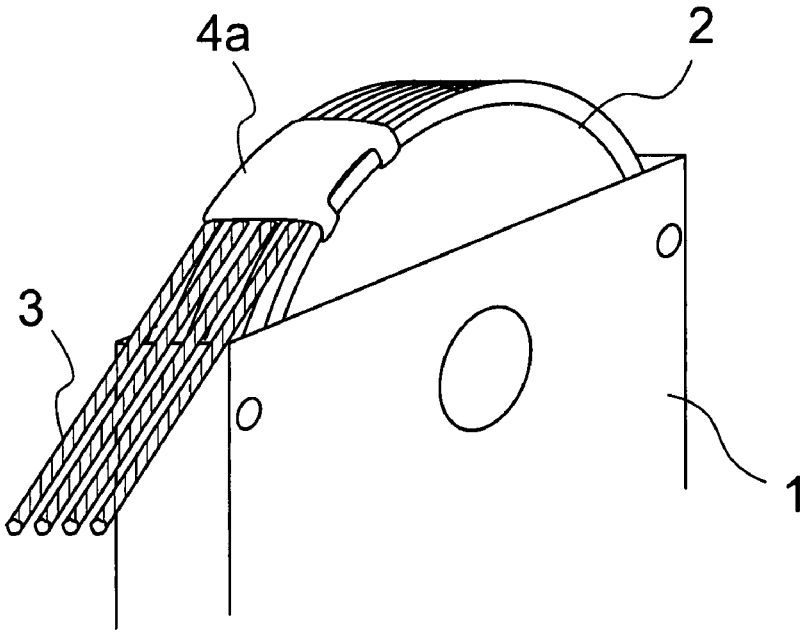
FIG. 7 presents an oblique top view of the rope holder in FIGS. 5 and 6 attached to an encased diverting pulley.

FIG. 5-7 present a short rope holder **4*a* according to a preferred embodiment of the invention for the mounting of ropes 3 on a rope pulley. A difference to the structure of the strip-like rope holder 4 mentioned above is that the rope holder 4*a* has no long, strip-like stem part 8. The structure, dimensions and function of the clamping part 7 together with the spring-like claws 5 are substantially identical to those of the strip-like rope holder 4 described above. Instead of an elongated stem part 8, the clamping part 7 has at its forward edge a substantially short projection 12 bent obliquely downwards, pointing in an obliquely downward and forward direction and having a width substantially equal to that of the clamping part 7. One of the functions of the projection 12 is to prevent the ends of the ropes 3 from coming out from under the forward edge of the clamping part 7 when the ropes are being pushed forwards. Thus, the ends of the ropes 3 can neither slide forwards nor bend freely away from the groove, in which case they might e.g. hit the jump guards inside the casing 1 or cause other problems. Alternatively, the edge of the rope holder can also be bent downwards to form a short bevel even if it has no projection 12**.

By the method of the invention, the ropes are mounted on a rope pulley by using a short rope holder 4*a* e.g. as follows. First, the ends of the ropes 3 are fitted into the groove of the rope pulley 2 and pressed into position by locking the clamping part 7 to the flange of the rope pulley 2 by means of the claws 5 so that the ends of the ropes 3 remain under the clamping part 7. After the ends of the ropes 3 have thus been locked to the rope grooves of the rope pulley 2 by clamping, the ropes 3 are mounted on the rope pulley 2 by suitably pushing the ropes 3 in their direction of advance and guiding the ropes 3 to pass around the rope pulley. The movement of the ropes 3 into position is additionally assisted if necessary by rotating the rope pulley 2 and simultaneously feeding the ropes 3 onto the rope pulley 2 in a suitable manner. The rope holder 4*a* protects the rope ends and guides the ropes along the grooves of the rope pulley around the rope pulley 2, and thus the jump guards in the casing near the outer rim of the rope pulley 2 are not an obstacle to the installation of the ropes.

It is obvious to the person skilled in the art that the invention is not limited to the example described above, but that it may be varied within the scope of the claims presented below. Thus, the shape and material of the rope holder may differ from those described above. The rope holder may be made partly or completely from a material other than band-like steel. For example, the stem part 8 may be made of plastic or a corresponding material while the clamping part 7 and claws 5 are of spring-like metal. The stem part 8 may also be a threadlike or soft band-like part.

It is additionally obvious to the skilled person that the clamping effect produced by the clamping part 7 and claws 5 can also be accomplished by using a different type of structure instead of a structure based on spring force. One expedient to solve the matter is to use e.g. tightening screws, eccentric elements or other corresponding structures to press the clamping part 7 against the ropes 3 and the outer surface of the rope pulley 2.

The invention claimed is:

1. A method for mounting one or more ropes on a rope pulley, the method comprising:

fitting a first end of the one or more ropes into one or more corresponding rope grooves of the rope pulley;

attaching a rope holder to the rope pulley to press the first end of the one or more ropes into the one or more corresponding rope grooves of the rope pulley;

setting the rope pulley in motion by pushing the one or more ropes in a direction of advance around the rope pulley; and winding the one or more ropes at least partially around the rope pulley by at least one of rotating the rope pulley and pushing the one or more ropes in a direction of advance around the rope pulley.

2. The method of claim 1, wherein the rope holder comprises:

a clamping part; and a plurality of claws connected to the clamping part.

3. The method of claim 2, wherein the rope holder further comprises:

a stem part connected to the clamping part.

4. The method of claim 2, wherein the clamping part presses the first end of the one or more ropes into the one or more corresponding rope grooves of the rope pulley.

5. The method of claim 2, wherein a width of the clamping part is substantially the same as a width of an outer rim of a corresponding rope pulley.

6. The method of claim 2, wherein attaching the rope holder to the rope pulley includes:

locking the plurality of claws to flanges of the rope pulley.

7. The method of claim 6, wherein locking the plurality of claws to flanges of the rope pulley causes the clamping part to press the first end of the one or more ropes into the one or more corresponding rope grooves of the rope pulley.

8. The method of claim 6, wherein locking the plurality of claws to flanges of the rope pulley generates a spring force to press the first end of the one or more ropes into the one or more corresponding rope grooves of the rope pulley.

9. The method of claim 2, wherein attaching the rope holder to the rope pulley includes:

using the plurality of claws to grip inner surfaces of flanges of the rope pulley.

10. The method of claim 2, wherein the rope holder further comprises:

a projection;

wherein the projection is disposed at a first end of the rope holder.

11. The method of claim 10, wherein the projection prevents the first end of the one or more ropes from coming out from under the clamping part when the one or more ropes are pushed toward the projection.

12. The method of claim 3, wherein winding the one or more ropes at least partially around the rope pulley includes rotating the rope pulley approximately one revolution so that a leading end of the stem part remains visible outside a casing of the rope pulley.

13. The method of claim 12, wherein rotating the rope pulley includes pulling the leading end of the stem part.

14. The method of claim 12, wherein the stem part includes an aperture, and wherein rotating the rope pulley includes pulling the leading end of the stem part using a device fixed to the stem part via the aperture.

15. The method of claim 3, wherein winding the one or more ropes at least partially around the rope pulley includes rotating the rope pulley approximately back to a starting point of the rotation so that a leading end of the stem part remains visible outside a casing of the rope pulley.

16. The method of claim 15, wherein rotating the rope pulley includes pulling the leading end of the stem part.

17. The method of claim 15, wherein the stem part includes an aperture, and wherein rotating the rope pulley includes pulling the leading end of the stem part using a device fixed to the stem part via the aperture.

18. The method of claim 1, wherein attaching the rope holder to the rope pulley generates a spring force to press the first end of the one or more ropes into the one or more corresponding rope grooves of the rope pulley.

19. The method of claim 1, further comprising:

bending a first end of the rope holder toward the rope pulley so as to prevent the first end of the one or more ropes from coming out from under the rope holder when the one or more ropes are pushed toward the first end of the rope holder.

* * * * *